United States Patent [19]

Radner et al.

[11] 4,114,386

[45] Sep. 19, 1978

[54] METHOD AND DEVICE FOR REMOVING RESILIENT GALLERY LINING FRAMES IN MINING AND TUNNELLING WHICH CONSIST OF A NUMBER OF SECTION SEGMENTS INSERTED ONE INTO ANOTHER IN A DISSIMILAR MANNER

[75] Inventors: Gerd Radner, Herne; Christoph Zillessen, Recklinghausen, both of Germany

[73] Assignee: Ruhrkohle, A.G., Germany

[21] Appl. No.: 795,347

[22] Filed: May 9, 1977

[30] Foreign Application Priority Data

May 28, 1976 [DE] Fed. Rep. of Germany ..... 2623909

[51] Int. Cl.[2] ..... E21D 11/22

[52] U.S. Cl. ..... 405/150

[58] Field of Search ..... 61/45 C, 45 R, 63, 45 D

[56] References Cited

FOREIGN PATENT DOCUMENTS

| | | | |
|---|---|---|---|
| 568,076 | 11/1958 | Belgium | 61/45 C |
| 1,167,177 | 11/1958 | France | 61/45 C |
| 99,248 | 9/1961 | Netherlands | 61/45 C |
| 949,200 | 2/1964 | United Kingdom | 61/45 C |
| 971,632 | 9/1964 | United Kingdom | 61/45 C |

*Primary Examiner*—Dennis L. Taylor

*Attorney, Agent, or Firm*—Andrus, Sceales, Starke & Sawali

[57] ABSTRACT

A method for removing resilient gallery lining frames in mining and tunnelling, such frames consisting of a number of mutually overlapping lining section segments with a box-like profile, comprises releasing the overlapping section segments from one another in order to recover the respective lining frames. The profile of the section segments has a longitudinal gap and overlapping ends of the segments are braced one with another by a wedge system acting on the longitudinal gap of the inner section, the segments being inserted one within the other in a dissimilar manner. At an overlapping region the outer section segment is bent outwardly to provide an opening at the longitudinal gap therein and the inserted end of the inner section segment at the overlap is moved substantially normal to the opening made by the outward bending to release the overlapping sections from one another.

12 Claims, 1 Drawing Figure

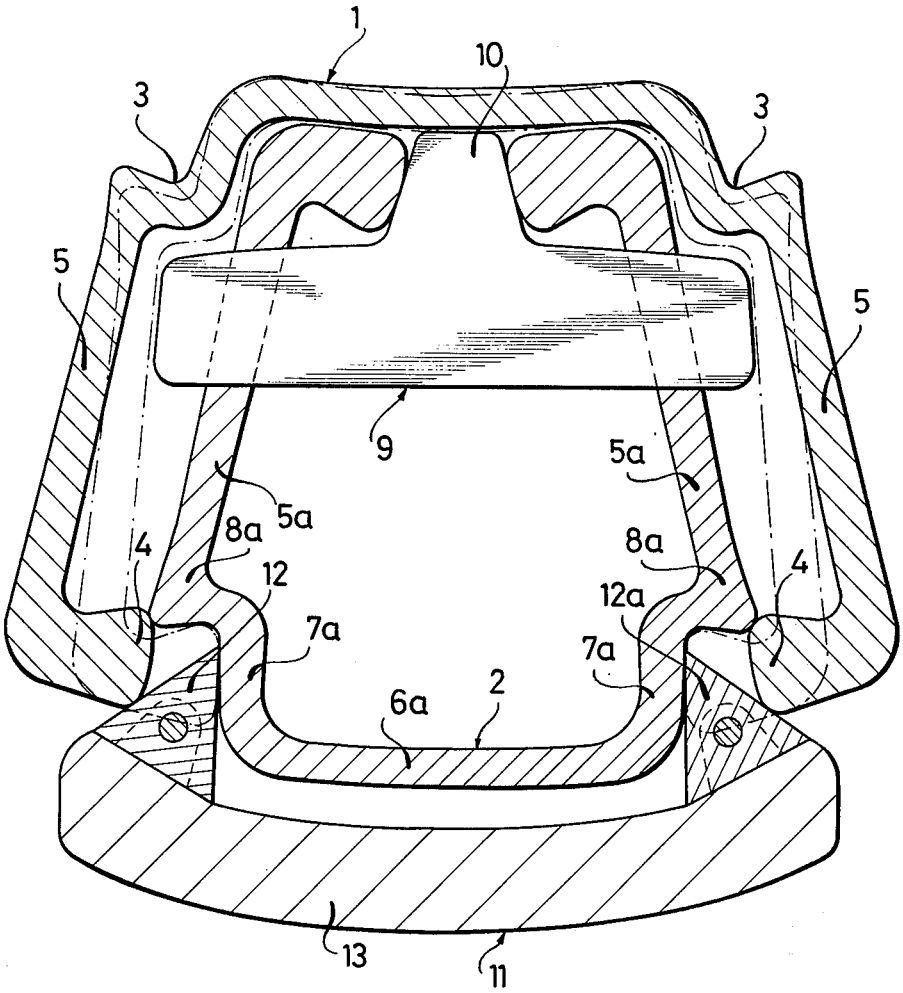
1
10
3
3
5
5
9
5a
5a
8a
8a
4
4
12
12a
7a
7a
2
6a
13
11

METHOD AND DEVICE FOR REMOVING RESILIENT GALLERY LINING FRAMES IN MINING AND TUNNELLING WHICH CONSIST OF A NUMBER OF SECTION SEGMENTS INSERTED ONE INTO ANOTHER IN A DISSIMILAR MANNER

BACKGROUND OF THE INVENTION (a) Field of the Invention

The invention relates to a method for removing resilient gallery lining frames in mining and tunnelling, consisting of a number of mutually overlapping lining section segments which have a box-like profile, preferably leaving free a longitudinal gap, and which are inserted into one another in a dissimilar manner by their overlapping ends and are optionally braced with respect to one another by a wedge system acting on a slot of the inner section, whereby any ties present are first removed, for example by loosening their nuts or by bending, and the section segments are then released from one another in order to recover the respective lining frames.

The gallery lining serves in mining and tunnelling for making safe and keeping open the galleries or corresponding chambers. The resilient gallery lining reacts as soon as a load exceeds the prescribed insertion resistance of the segments, which is set up and maintained in the overlapping end regions. Because of this the lining yields. No dangerous deformation of the gallery lining frame takes place along the prescribed insertion path. The cost of a resilient gallery lining frame makes removal, that is recovery, of the gallery lining worth while when the gallery has served its purpose. As a rule, the gallery lining which has been removed is straightened and then used again.

(b) Description of the Prior Art

Resilient gallery lining frames consisting of so-called hollow sections inserted one in another are known. During the removal of such lining frames, the nuts of the ties, which hold together the adjacent segments in the overlaps and are necessary to brace them, are loosened. As a result of this, the cohesion of the ends of the segments is immediately lost. Consequently, the lining frames can be recovered directly after removal of the ties.

A disadvantage, however, is that because of the insertion of the segments, repeated, i.e. intervening, tightening of the nuts and because of rust, loosening the ties using spanners or similar tools is only rarely possible. In the few cases in which nuts can be loosened from ties, the use of spanners is ruled out because of the dangerous nature of this work, which results from loss of the cohesion of the ends of the segments. It is, therefore, customary to loosen the nuts from a distance with expressly developed devices, for example to blow them off, and to remove the lining in so far as it is still standing. This method is, however, not applicable to the gallery lining frames described at the beginning and not pertaining to the state of the art. For such a resilient gallery lining, because of its segment ends inserted one into another in a dissimilar manner, has the characteristic that, even after the loosening of any ties present, the lining section segments hold together and the gallery lining frame remains standing.

The invention is therefore aimed at making it possible to remove without danger a gallery lining as described at the beginning of this specification, having sections inserted one into another in a dissimilar manner, and thus to effect recovery of the lining.

SUMMARY OF THE INVENTION

This problem is solved with the method of working according to the invention in that the outer section segment is bent outwards at the overlap and the ends of the segments which are inserted one into another are moved substantially normal to the opening made by the bending outwards and are thus released from one another.

If it is necessary to remove beforehand any ties present this is not dangerous, because even after loosening the ties the lining remains whole. Consequently the well-known spanners can also be used for loosening the ties. If ties are not present, because with a lining of this kind they fulfil only a subordinate role, the method according to the invention is correspondingly simplified.

Bending the outer section segment serves to release the inserted inner section segment which can subsequently either be extracted or which may even slide out of the outer section of its own accord. The gallery lining frame then collapses. It is not necessary to bend the entire outer section. As a rule, it is sufficient to deal suitably with the partial length overlapping with the inner section.

The new method has the advantage of being able to be carried out relatively safely because the section segments inserted into one another can be separated by controlled bending of the outer section segment. In this way, the risks inherent in the removal can be overcome. In general, deformation is restricted to a very small part of the section segment, so that it can be readily reversed by subsequent straightening.

Preferably and according to another characteristic of the invention, safety during removal is further improved by allowing the wedge system of the lining, which is usually present, to continue to act for as long as possible. To this end, it is proposed that bracing of the segments in the direction of insertion should be maintained during the bending and the subsequent loosening.

This maintenance of the bracing of the ends of the segments is preferably effected in such a way that the segments insert further in a controlled manner. In this way, it is possible to exert a better control over the collapse of the gallery lining frame which must follow the loosening of the section segments.

Control of insertion during the bending of the outer section is effected preferably, i.e. according to a further characteristic of the invention, by stretching the inner section.

It is also an advantage if the forces required for bending the outer section are supported on the section itself and not on its surroundings. To this end, it is consequently proposed according to the invention that the forces serving to bend the outer section should be supported on the longitudinal edges or faces bounding the gap of the outer section and on the adjacent edges or faces of the inner section.

This embodiment of the method according to the invention has the advantage that no special counter support is required during removal.

Details, further characteristics and other advantages of the invention will be seen from the following description of an embodiment, by way of example, of the device according to the invention for carrying out the method described, with reference to the accompanying drawing.

BRIEF DESCRIPTION OF THE DRAWING

The drawing shows a section through the overlap of two lining section segments.

DESCRIPTION OF THE PREFERRED EMBODIMENT

In the drawing an outer section segment is designated by 1 and the inner section by 2. The sections are formed indentically, so that it is sufficient to explain the principal parts of the profile of one such section.

The profile defines approximately at its centre a bottom of a section to which is joined at either side an angle designated by 3. Flanges 5 of the section, which with the inner section converge (as shown at 5*a*), adjoin the angles. Section flanges 5*a* terminate in ears bent inwards substantially at a right angle, which with the outer section are designated by 4. The ends of these lining sections are now inserted one into another in a dissimilar manner in such a way that the ears 4 of the outer section bear in the recess between the short flange sectors 7*a* of the inner section directly adjoining the bottom 6*a* of the section and the adjoining sectors 8*a* bounding the angles referred to. This condition is shown in the drawing by broken lines for the outer section. Bracing of the ends of the section is effected at least in part by means of a wedge system, generally designated by 9, having a retractable wedge 10 which acts on the slot or gap bounded by the ears of the inner section. If required, ties can also be provided in the region of overlap.

Further details of the gallery lining frame may be found in U.S. patent application, Ser. No. 795,348 filed on an even date herewith by the same applicants and others.

The method according to the invention is principally proposed for a gallery lining frame consisting of lining section segments having a profile shaped as illustrated. It is carried out with a stretching device which is generally designated by 11. This stretching device has a number of wedges, designated by 12 and 12*a* in the embodiment illustrated, as well as a connecting piece 13, which holds these wedges apart at a distance fixed by their bearing on flanges 7*a* of the inner section 2. Not represented, but indicated only by a broken line, is a drive which can move the stretching device 11, consisting of the wedges 12 and 12*a* and the connecting piece 13, along the section segments.

The stretching device 11 is already functioning as shown in the drawing to the extent that the ears 4 of the outer section segment 1 have already been forced apart so far that they have protruded over the ends 8*a* of flanges 5*a* of the inner section segment and have thus released the inner section segment 2. Consequently, the inner section segment can be withdrawn from the outer section segment. Wedges 12, 12*a* need therefore be driven only so far between the ears 4 of the outer section segment 1 and the side flanges 7*a* of the bottom 6*a* as will allow the ears 4 to pass over ends 8*a*. During this process, the stretching device 11 bears in the angles 3 of the outer section segment, which is, however, not illustrated in detail in the drawing. In this way, the forces required for stretching can be applied without special counter support.

Moreover, because of the bending of the outer section segment, the wedge system 9 loses to a considerable extent its contact with the inner sides of flanges 5 of the outer section segment 1. However, the retractable wedge designated by 10, which in the embodiment illustrated in integrated into the wedge system 9, largely continues to function, especially if during the loosening process it is, for instance, driven in further by connection with the stretching device 11. On account of this, the outer and the inner segment can, if required, penetrate into one another slowly and to a small extent. Driving in or further driving the retractable wedge 10 with the aid of the stretching device makes it possible during the stretching process to control the bracing of the segments and to maintain it in such a manner that the cohesion of the segments is not lost unexpectedly. The work force is not put in danger by this process, even if it is effected manually, because the wedge system remains for as long as possible within the self-enclosed box section.

The lining frame can, therefore, be removed after loosening the two section segments 1 and 2 from one another. This removal takes place substantially normal to the opening made by the upward bending.

The removal operations must naturally often be carried out in restricted circumstances. The stretching device described allows for this in that it is very narrow and can be used as described, because of which its functional efficiency is retained even if the rock between individual lining frames is squeezed or crushed. The wedges 12 and 12*a* are preferably of such length as corresponds to the area to be widened. Basically, they can be driven in by hand.

However, it is preferable to use a mechanical drive or one driven by hydraulic means.

As wedges 12 and 12*a* must be moved substantially vertically to the bottom 2 of the section, i.e. along the flanges 7*a*, they must have such a slope on the outer sides that the ears 4 are forced outwards over the ends of flanges 8*a* before the limit of wedge penetration is reached.

The longer or wider such a wedge is, the greater the force which has to be applied by the drive. In this connection, a balanced relationship is to be aimed at.

In so far as the conditions permit, the drive may be formed by a hydraulic strut for example a hydraulic pit prop placed across the gallery so as to press the wedges 12 and 12*a* between the ears 4 and flanges 7*a*. On the other hand, the drive may be contrived in such a way that the stretching device can be operated from a distance, so as to be able to carry out the work of removal from a safe position. For this purpose a drivable roller or friction wheel system is proposed. As compressed air galleries are commonly available below ground and compressed air possesses favourable properties on account of the compressibility of the medium and the flow conditions, the stretching device may be equipped with a pneumatic drive.

Finally it is possible to design a mechanical drive in the form of the well-known Nuremberg scissors. Such a drive has the advantage of diverting the forces, so that the inner section is not stressed on bending.

We claim:

1. A method for removing gallery lining frames formed of at least inner and outer deformable frame segments, each of said segments having a generally C-shaped cross section with a pair of arms joined by an intermediate connection member having an exterior flange, the ends of said segments being slid into one another with the C-sections of the segments opening in opposite directions to form a closed tube in a region of overlap, said method comprising the steps of:

releasing any forces applied to said segments parallel to the plane of the cross sections and urging the overlapping segment ends into contact;

forcing the arms of the outer segment apart at the end thereof an amount sufficient to permit release of the end of the inner member; and moving the end of the inner member substantially normal to the opening between the arms of the outer member to release the overlapping segments from one another and recover the lining frame.

2. A method according to claim 1, wherein the overlapping segments are braced in the overlapping region and the bracing of the segments in the direction of insertion is maintained during the forcing apart and the resultant loosening.

3. A method according to claim 2, wherein the maintenance of the bracing of the segments in the direction of insertion is effected in such a way that the segments insert further one into another in a controlled manner.

4. A method according to claim 2, wherein during the maintenance of the bracing of the segments the inner section is stretched.

5. A method according to claim 2 wherein said segments have longitudinal gaps between the pair of arms and wherein the overlapping segments are braced by a wedge system acting on the longitudinal gap of the inner section in the overlapping region, said bracing being maintained during the forcing apart and resultant loosening of the segments.

6. A method according to claim 1 wherein the forces forcing apart the arms of the outer segment are applied along the ends of the arms of the outer segment and the adjacent portions of the inner segment.

7. A means for removing a gallery lining frame, said frame comprising at least outer and inner deformable frame segments having generally C-shaped cross sections with pairs of arms joined by intermediate connection members having exterior flanges, said outer segment having an expanded cross sectional configuration at an end thereof, said inner segment having a contracted cross sectional configuration at an end, said segments being slid together at said ends with the C-shaped sections opening in opposite directions to form a closed tube in a region of overlap with said arms of said outer segment engaging the flange of said connecting member of said inner segment, said removal means comprising:

a base member;

at least a pair of wedges spacedly mounted on said base member a distance approximating the width of the flange of said connecting member of said inner segment; and drive means for applying said wedges to said segments in the region of overlap to drive the wedges between the arms of the outer member and along the sides of the flange of said connecting member of said inner segment for forcing the arms of the outer segment apart at the end to permit release of the end of the inner member.

8. The means according to claim 7 wherein said drive means for said means for removing comprises at least one of a roller and friction wheel system.

9. The means according to claim 7 wherein said drive means comprises hydraulically driven apparatus.

10. The means according to claim 7 wherein said drive means comprises a hydraulic pit prop.

11. The means according to claim 7 wherein said drive means is constructed as a Nuremburg scissor.

12. The means according to claim 7 wherein said means for removing is adapted to be connected with a wedge system of said frame by which said overlapping segments are braced in the overlapping region.

* * * * *